US005706398A

United States Patent [19]

Assefa et al.

[11] Patent Number: 5,706,398

[45] Date of Patent: Jan. 6, 1998

[54] METHOD AND APPARATUS FOR COMPRESSING AND DECOMPRESSING VOICE SIGNALS, THAT INCLUDES A PREDETERMINED SET OF SYLLABIC SOUNDS CAPABLE OF REPRESENTING ALL POSSIBLE SYLLABIC SOUNDS

[76] Inventors: Eskinder Assefa, 11500 Pinehurst Wy. NE, Apt. 307, Seattle, Wash. 98125; Paul A. Toliver, 2320 W. Viewmont Way W., Seattle, Wash. 98199

[21] Appl. No.: 434,439

[22] Filed: May 3, 1995

[51] Int. Cl.[6] ..... G10L 5/00

[52] U.S. Cl. ..... 395/2.58; 395/2.63; 395/2.59; 395/2.87

[58] Field of Search ..... 395/2.15, 2.62, 395/2.63, 2.56, 2.57, 2.58, 2.64

[56] References Cited

U.S. PATENT DOCUMENTS

| | | | |
|---|---|---|---|
| 3,770,892 | 11/1973 | Clapper | 395/2.62 |
| 4,415,767 | 11/1983 | Gill et al. | 395/2.58 |
| 4,751,737 | 6/1988 | Gerson et al. | 395/2.15 |
| 4,769,844 | 9/1988 | Fujimoto et al. | 395/2.57 |
| 4,827,519 | 5/1989 | Fujimoto et al. | 395/2.57 |
| 4,885,791 | 12/1989 | Fujii et al. | 395/2.62 |
| 4,908,864 | 3/1990 | Togawa et al. | 395/2.58 |
| 4,975,959 | 12/1990 | Benbassat | 395/2.63 |
| 4,985,924 | 1/1991 | Matsuura | 395/2.63 |
| 5,054,084 | 10/1991 | Tanaka et al. | 395/2.63 |
| 5,191,635 | 3/1993 | Fujimoto | 395/2 |
| 5,434,933 | 7/1995 | Karnin et al. | 382/317 |

OTHER PUBLICATIONS

Furui, (Digital Speech Processing, Synthesis, and Recognition, "Speech Recognition", Chapter 8, pp. 225–289, 1989, Marcel Dekker, Inc, New York, NY), Jan. 1989.

*Primary Examiner*—Allen R. MacDonald
*Assistant Examiner*—Vijay B. Chawan
*Attorney, Agent, or Firm*—Christensen O'Connor Johnson & Kindness PLLC

[57] ABSTRACT

A method and apparatus for compressing voice signals for storage and later retrieval is disclosed. The apparatus includes a microphone, a voice processor, a speaker and data storage. The apparatus forms a voice recognition template that associates a unique binary code word with each distinct syllabic sound in a particular language. When a user wishes to store voice signals using the apparatus, the user speaks into the microphone. For each syllable of the voice signal, the microphone provides the syllable to a voice processor. The voice processor formulates the frequency signature for the syllable. The frequency signal is compared to voice recognition template and the associated binary code word closest to the spoken syllable is stored within the data storage.

20 Claims, 6 Drawing Sheets

| | a 001 | u 010 | i 011 | a 100 | e 101 | e 110 | o 111 |
|---|---|---|---|---|---|---|---|
| 00000 | Hūh | Hoo | Hee | Hāh | Hay | Hē | Hōh |
| 00001 | Lūh | Loo | Lee | Lāh | Lay | Lē | Lōh |
| 00010 | Mūh | Moo | Mee | Māh | May | Mē | Mōh |
| 00011 | Rūh | Roo | Ree | Rāh | Ray | Rē | Rōh |
| 00100 | Sūh | Soo | See | Sāh | Say | Sē | Sōh |
| 00101 | Shūh | Shoo | Shee | Shāh | Shay | Shē | Shōh |
| 00110 | Būh | Boo | Bee | Bāh | Bay | Bē | Bōh |
| 00111 | Tūh | Too | Tee | Tāh | Tay | Tē | Tōh |
| 01000 | Chūh | Choo | Chee | Chāh | Chay | Chē | Chōh |
| 01001 | Nūh | Noo | Nee | Nāh | Nah | Nē | Nōh |
| 01010 | Ūh | Oo | Ee | Āh | Ay | Ē | Ōh |
| 01011 | Kūh | Koo | Kee | Kāh | Kay | Kē | Kōh |
| 01100 | Wūh | Woo | Wee | Wāh | Way | Wē | Wōh |
| 01101 | Zūh | Zoo | Zee | Zāh | Zay | Zē | Zōh |
| 01110 | Yūh | Yoo | Yee | Yāh | Yay | Yē | Yōh |
| 01111 | Dūh | Doo | Dee | Dāh | Day | Dē | Dōh |
| 10000 | Jūh | Joo | Jee | Jāh | Jay | Jē | Jōh |
| 10001 | Gūh | Goo | Gee | Gāh | Gay | Gē | Gōh |
| 10010 | Fūh | Foo | Fee | Fāh | Fay | Fē | Fōh |
| 10011 | Pūh | Poo | Pee | Pāh | Pay | Pē | Pōh |
| 10100 | Vūh | Voo | Vee | Vāh | Vay | Vē | Vōh |
| 10101 | $K^h$ūh | $K^h$oo | $K^h$ee | $K^h$āh | $K^h$ay | $K^h$ē | $K^h$ōh |
| 10110 | Ǩūh | Ǩoo | Ǩee | Ǩāh | Ǩay | Ǩē | Ǩōh |
| 10111 | Ňūh | Ňoo | Ňee | Ňāh | Ňay | Ňē | Ňōh |
| 11000 | Žūh | Žoo | Žee | Žāh | Žay | Žē | Žōh |
| 11001 | Ťūh | Ťoo | Ťee | Ťāh | Ťay | Ťē | Ťōh |
| 11010 | Čhūh | Čhoo | Čhee | Čhāh | Čhay | Čhē | Čhōh |
| 11011 | Ƥūh | Ƥoo | Ƥee | Ƥāh | Ƥay | Ƥē | Ƥōh |
| 11100 | Ťsūh | Ťsoo | Ťsee | Ťsāh | Ťsay | Ťsē | Ťsōh |
| 11101 | Thūh | Thoo | Thee | Thāh | Thay | Thē | Thōh |
| 11110 | | | | | | | |
| 11111 | | | | | | | |

Fig. 5.

METHOD AND APPARATUS FOR COMPRESSING AND DECOMPRESSING VOICE SIGNALS, THAT INCLUDES A PREDETERMINED SET OF SYLLABIC SOUNDS CAPABLE OF REPRESENTING ALL POSSIBLE SYLLABIC SOUNDS

FIELD OF THE INVENTION

This invention relates to voice storage systems and, more particularly, to a voice storage system using a syllabic sound look-up table.

BACKGROUND OF THE INVENTION

The most common method of storing data, and particularly alphanumeric characters, in computer systems is by the use of an 8-bit byte. A bit is a representation of two predefined states of an electrical current which the computer can read and interpret as either a "0" or a "1". This is referred to as binary encoding.

In character-based data storage, these bits (0s and 1 s) are arranged into bytes to form a more complex value or character. In this scheme, because each character has 8 bits, and binary encoding allows for only two possible values for each bit, there are a maximum of 256 different combinations of these 8 bits. These different combinations are used to represent the letters of the alphabet, numerals, and special characters. An example of such a scheme is International Business Machines' Extended Binary Code Decimal Interchange Code ("EBCDIC").

Although the storage of data using EBCDIC is easily implemented, it has been found that for some applications, EBCDIC requires an overly large amount of memory. In order to solve this problem, many in the field have attempted various data compression techniques. These techniques have been met with varying degrees of success.

One important use of data compression is voice storage technology. However, it has been found that English is a language that has numerous characteristics that make it extremely difficult to represent using voice recognition. These characteristics include exceptions to various rules, the use of vowels, etc. Even with these challenges, companies like IBM have developed products that allow users to dictate reports to a computer, which in turn will translate these voice signals into digital representations, which then must be translated into the appropriate words.

This prior art system utilized complex mathematical models for language that included a minimum of 30,000 words in its vocabulary for the software. The size of the vocabulary necessarily requires a significant amount of hardware. Specifically, the software requires a large amount of random access memory, as well as a large amount of hard disk space. Therefore, this prior art system has the disadvantage of being unduly cumbersome for practical and affordable use.

SUMMARY OF THE INVENTION

A method and apparatus for compressing voice signals for storage and later retrieval is disclosed. The apparatus includes a microphone, a voice processor, a speaker and data storage. The apparatus forms a voice recognition template that associates a unique binary code word with each distinct syllabic sound in a particular language. In the preferred embodiment, the voice recognition template is formed by having a plurality of human speakers speak each syllabic sound into the microphone. The voice processor represents each syllabic sound that is input by each human speaker as a frequency signature. The frequency signatures for all of the human speakers for each specific syllabic sound are then compiled to form a composite frequency signature for each syllabic sound. The plurality of composite frequency signatures are then used by the apparatus to process voice signals from a user for storage.

When a user wishes to store voice signals using the apparatus, the user speaks into the microphone. For each syllable of the voice signal, the microphone provides the syllable to a voice processor. The voice processor formulates the frequency signature for the syllable. The frequency signal is compared to all of the composite frequency signatures in the voice recognition template. The composite frequency signature that is closest to the frequency signature of the syllable is found. The associated binary code word to the composite frequency signature chosen is stored within the data storage.

In accordance with other aspects of the present invention, a playback template is formulated that allows playback of the stored voice signals. The voice processor retrieves the binary code words and generates over the speaker a predetermined voice signal associated with each particular binary code word.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 5 is a table of syllabic sounds based upon the Amharic language.

DETAILED DESCRIPTION OF THE PREFERRED EMBODIMENT

Figure 1:
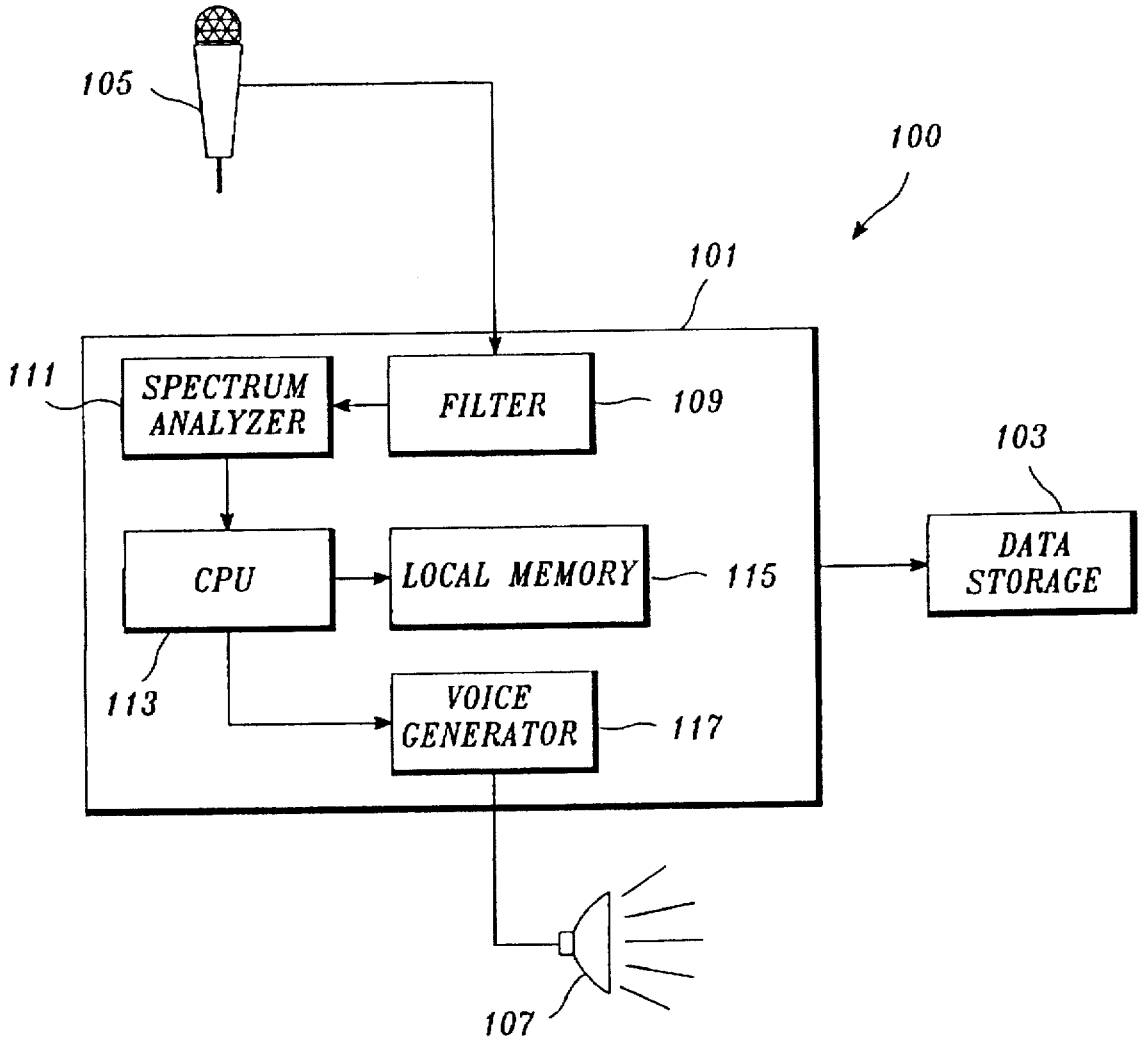
FIG. 1 is a schematic diagram of an apparatus formed in accordance with the present invention.

As seen in FIG. 1, an apparatus 100 configured in accordance with the present invention includes a voice processor 101, a data storage device 103, a microphone 105, and a speaker 107. These elements operate to implement the method of the present invention.

Figure 2A:
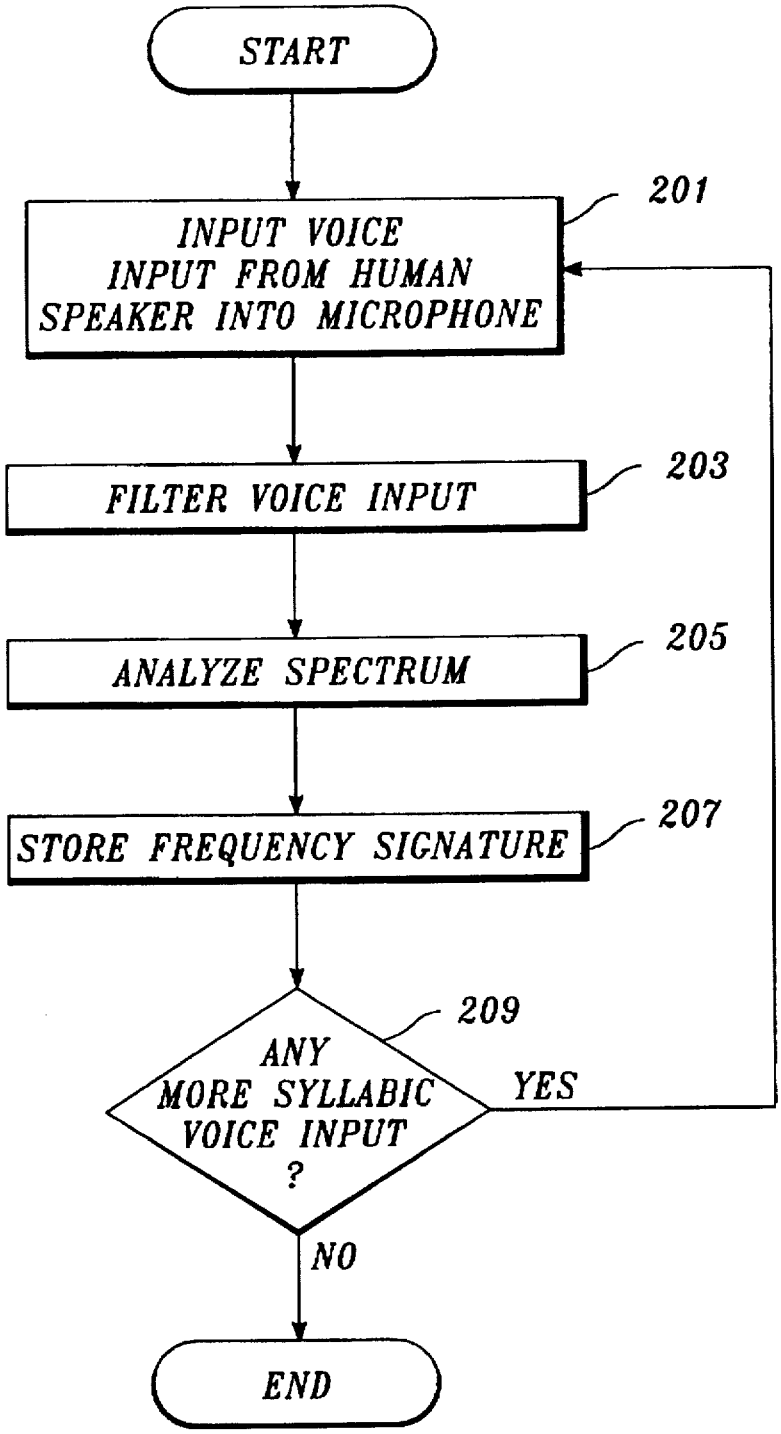
FIGS. 2A and 2B are flow diagrams illustrating the method of generating the voice recognition template.

The initial step is formulating a voice recognition template. The voice recognition template is a representation of all of the multiple syllabic sounds possible in a particular language, such as English. Turning to FIG. 2A, at box 201 a training voice signal is provided into the microphone 105. The training voice signal is an analog voice signal that is read into the microphone 105 by a training speaker. The training speaker reads into the microphone 105 all of the possible syllabic sounds in English. In the preferred embodiment, the training speaker will read from a predetermined list of syllabic sounds. It has been found that there are less than two-hundred fifty-six (256) distinct major syllabic sounds in English. Similarly, for most other languages, there are less than two-hundred fifty six distinct major syllabic sounds. Nevertheless, as will be seen below, even for language with greater than two-hundred fifty six syllabic sounds, it is easy to adapt the present invention to accommodate these languages.

In the preferred embodiment, as seen in FIG. 5, the table of syllabic sounds is based upon the Amharic language spoken in Ethiopia. It has been found that the Amharic language contains almost all of the syllabic sounds of all languages. The table shown in FIG. 5 is the "base table." If additional syllabic sounds are necessary, such as for certain specific languages, the table can be expanded by adding sounds in the spaces left blank. As seen in FIG. 5, eight-bit binary values have also been assigned to each table entry. One advantage of the present invention is its flexibility which lends itself to easy customization for specific languages. This flexibility can be realized not only by the capacity to add new syllables to the table, but also by the exclusion of syllables in the "base" table that are not part of the specific language. For example, the syllables found at row "11100" of FIG. 5 are not typically used in English. Therefore, by removing this row for English, we gain another row of empty space and also realize faster performance for a voice system using this "optimized" table (i.e., whatever the method that is used with this optimized table, the method must only deal with a lesser number of syllabic sounds instead of a full set as shown in the "base" table).

As each syllabic sound is read into the microphone 105 as a training voice signal, at box 203, the voice processor 101 routes the training voice signal to a filter 109 which eliminates low-level and high-level noise. In the preferred embodiment, the filter is a band-pass filter that allows frequencies within the human spoken range of 300 Hz to 2800 Hz pass. All other frequencies should preferably be eliminated as noise.

Next, after filtering, at box 205, the training voice signal is provided to a spectrum analyzer 111 that, in accordance with known techniques, provides a frequency signature of the voice input. Typically, the frequency signature is a vector of amplitudes for each frequency within the voice spectrum. Thus, for example, the frequency signature could be represented as $[a_1f_1, a_2f_2, \ldots a_{n-1}f_{n-1}, a_nf_n]$, where $a_n$ is the amplitude of the voice input at frequency $f_n$. The length of the frequency signature vector is predetermined and is dependent on a large extent on the particular spectrum analyzer 111.

Further, it can be appreciated that there may be other methods of representing the training voice signal and the spectrum analyzer is merely illustrative. Any of a number of well known methods for representing the training voice signal may be used with equal efficacy. The important functionality is that the voice processor 101 includes a mechanism for representing the training voice signal in a distinctive manner.

Next, at box 207, the spectrum analyzer 111 provides the frequency signature to CPU 113 which stores the frequency signature in local memory 115.

Next, at box 209, a determination is made as to whether or not all syllable sounds from the predetermined list have been input by the training speaker. If there are no more syllables to be input, the training procedure ends. However, if there are additional syllables to be input, then control is returned to box 201 and the steps of box 201 through box 209 are repeated until all syllabic sounds have been input. It is advantageous to form the voice recognition template not from a single training speaker, but from a plurality of training speakers to allow for normal variations in pronunciation and inflection in spoken English.

Figure 2B:
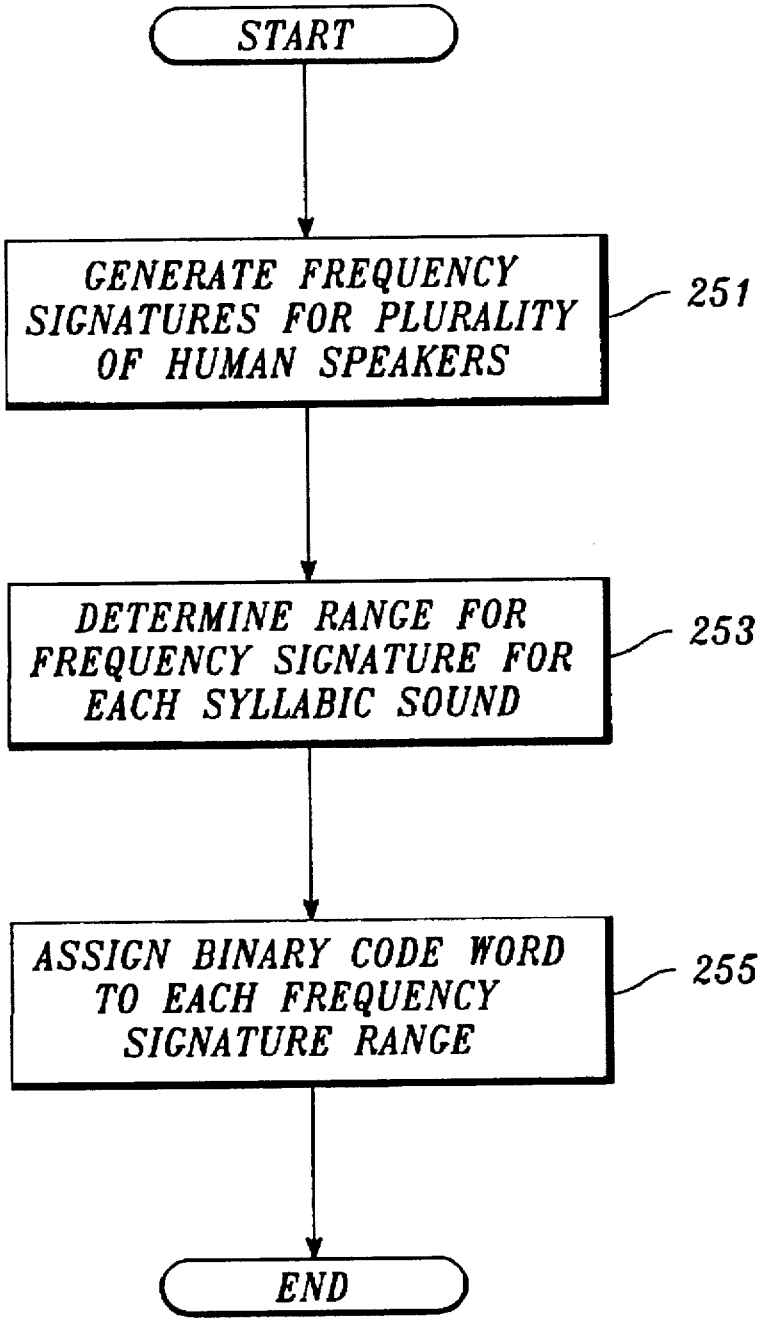

Thus, in the preferred embodiment, turning now to FIG. 2B, at step 251, the frequency signatures from a plurality of training speakers are generated and stored in accordance with the procedure of FIG. 2A. The next step in forming the voice recognition template is at box 253 where a composite frequency signature representation for each syllabic sound is formed from the plurality of frequency signatures for that syllabic sound. In the preferred embodiment, the frequency signatures from the training speakers are examined by CPU 113 to generate the composite frequency signature for each syllabic sound. The composite frequency signature is a vector that includes a range of amplitudes for each frequency within the frequency signature. This composite frequency signature is generated to account for normal variations in speech between various users.

Returning to the example above where a single frequency signature for a specific syllable is represented as $[a_1f_1, a_2f_2, \ldots a_{n-1}f_{n-1}, a_nf_n]$, a second and a third frequency signature for a second and third human speaker can be represented as $[b_1f_1, b_2f_2, \ldots b_{n-1}f_{n-1}, b_nf_n]$and $[c_1f_1, c_2f_2, \ldots c_{n-1}f_{n-1}, c_nf_n]$, respectively. A range of amplitudes, i.e., for the values a, b, and c, can be determined from simple statistical analysis. In the preferred embodiment, the range is two standard deviations from the average amplitudes of all of the amplitudes from the training speakers. Thus, the composite frequency signature for each syllabic sound is represented as: $[(z_h \text{ to } z_1)_1f_1, (z_h \text{ to } z_1)_2f_2, \ldots (z_h \text{ to } z_1)_{n-1}f_{n-1}, (z_h \text{ to } z_1)_nf_n]$, where $(z_h \text{ to } z_1)_n$ is the acceptable amplitude range for the $n^{th}$ frequency and where $z_h$ is the amplitude two standard deviations greater than the mean amplitude for that frequency for all of the training speakers and where $z_1$ is the amplitude two standard deviations lower than the mean amplitude for that frequency for all of the training speakers.

Next, at box 255, the CPU 113 assigns a unique binary code word to each composite frequency signature. In the preferred embodiment, the binary code word is an 8-bit word since there are less than 256 composite frequency signatures. It can be appreciated that if a language has greater than 256 syllabic sounds, and therefore greater than 256 composite frequency signatures, a 9-bit word for the binary code word is necessary. The association of the binary code word to each composite frequency signature forms the voice recognition template. The voice recognition template is preferably formulated as a look up table in CPU 113 and local memory 115.

As noted above, in the preferred embodiment, training voice signals from a plurality of training speakers are analyzed and stored. By analyzing multiple training speakers, a wide range of speaker inflections and variations can be accounted for. Thus, it is advantageous to have a large number of training speakers provide voice input. Moreover, the training speakers can be selected to attempt to mirror the user's speech characteristics. For example, if the apparatus is to be used in the southern U.S., training speakers from the southern U.S. should be used to generate the voice recognition template. This customization can serve to counteract language differences as a result of regional dialects. In addition, if it is known that the user of the apparatus will be male or female, then the voice recognition template can be formulated from training speakers that are male or female, respectively. In short, it is preferable to form the voice recognition template from training voice signals that closely mirrors the end user's vocal characteristics.

Towards that end, in one embodiment of the present invention, the apparatus allows the end user to form his or her own voice recognition template. In this embodiment, the user can act as the training speaker and formulate his own voice recognition template. This method of forming the voice recognition template is most advantageous when the apparatus 100 is to be used only by a single user. In contrast, if apparatus 100 is to be used by a variety of users, then a more generic voice recognition template should be utilized.

One advantage of the present invention is that it is based upon the syllabic sound as contrasted to the word sound. Although the English language may have less than 256 major syllabic sounds, the English language would have tens of thousands of words. It is contemplated within the scope of this invention that the voice recognition template may be formed from the training speakers reading each word of the English language into the apparatus 100. However, because of the large number of words, the time involved in forming the voice recognition template may be prohibitive. In addition, the storage and processing requirements for such generating and using such a template would be significant. Therefore, it can be seen that forming the voice. recognition template based upon syllabic sounds, and not word sounds, represents a significant savings in processing time and storage space.

Figure 3:
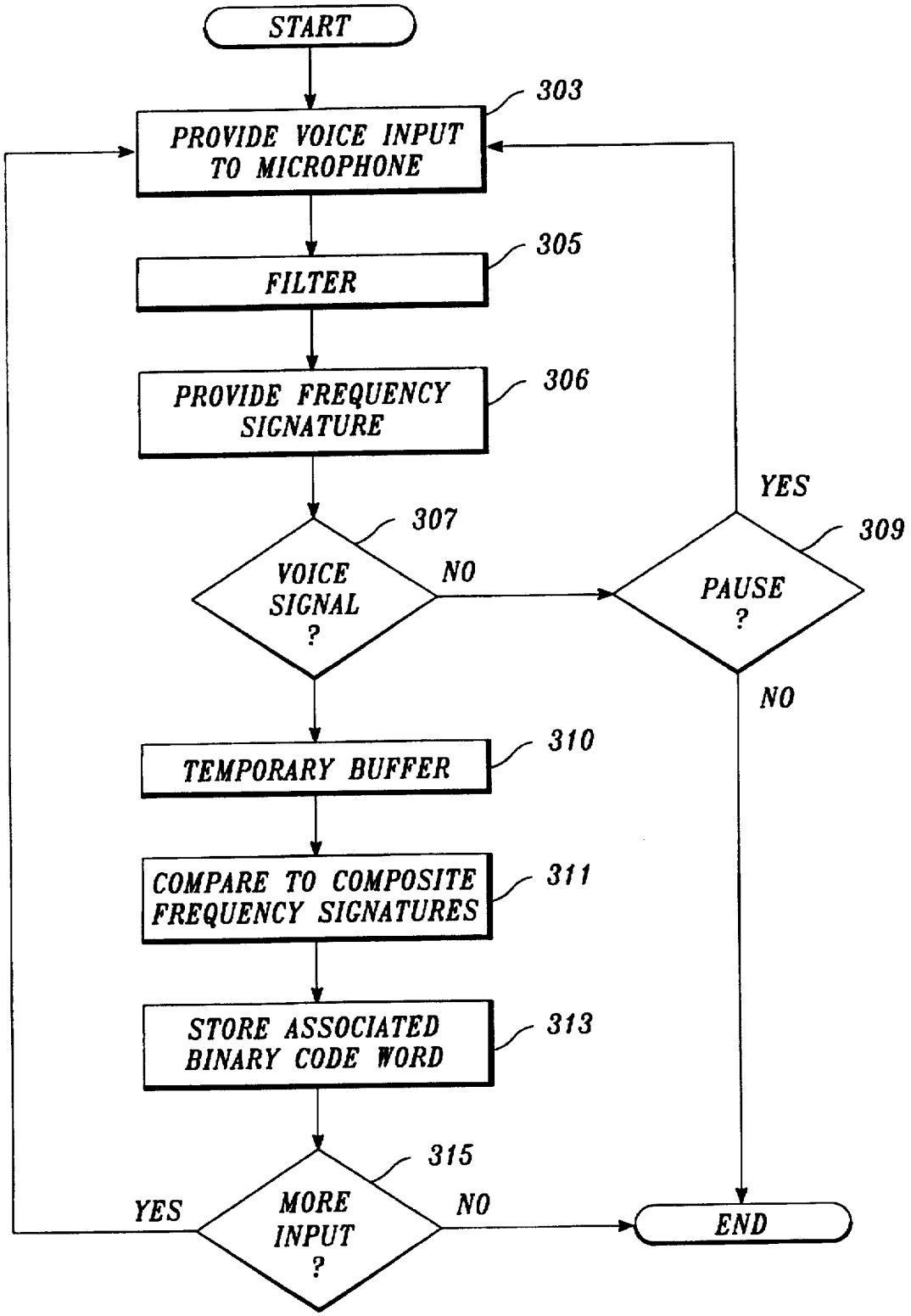
FIG. 3 is a flow diagram illustrating the analysis of an input voice signal and storage thereof.

Subsequent usage of this voice recognition template by a user allows any voice signal received by the microphone 105 to be represented as a binary code word. The process is illustrated in FIG. 3. First, at box 303, the analog voice signal that is to be stored is input into the microphone 105 by the user. Next, filter 109 of voice processor 101 filters the voice signal. At box 306, the voice signal is provided to spectrum analyzer 111 which provides a frequency signature of the voice input.

At box 307, the frequency signature is analyzed to determine whether or not it is a voice signal. If it is determined that it is not a voice signal, then at box 309, the voice processor 101 determines whether or not it is a pause in the speech. If it is a pause in the speech, then control returns to box 303, where the microphone 105 awaits another voice signal. If the signal is not a pause, then at box 311, the process is terminated and it is determined that the input sound was not a voice signal, but rather spurious noise. Alternatively, in the event that a pause is detected, then after box 309, a binary code word representative of a silence or pause may be stored.

If at box 307 it is determined that the input to the microphone is a voice signal, it is placed into a temporary buffer within CPU 113 at box 310. Next, at box 311, the frequency signature is compared with each composite frequency signature in the voice recognition template. If all of the amplitudes of the frequency signature fits within a composite frequency signature, then at box 311 the binary code word associated with that composite frequency signature is stored. Next, at box 315, a determination is made as to whether there is any additional syllabic sound voice signal input. If not, then the procedure terminates. If so, then control is returned to box 303. It should be noted that by the term "voice signal," it is meant the syllabic sound that is uttered from the user. Thus, the process of FIG. 3 is repeated each time a syllabic sound is spoken by the user.

It can be seen that the storing of signals from the voice recognition template provides a simple method for assigning binary code words to voice signals. The system also requires less storage than what conventional schemes use to store syllable-equivalent voice signals. For example, for the voice signal "Go to A," a conventional system will store it in 40 bits (8 bits per character times 5 characters), while the method of the present invention could store it in 24 bits, i.e., 3-syllable sounds. It has been found that the 40% gain in storage surplus is an average than can be duplicated across the board.

One important application of the present invention is in voice mail systems where the voice mail storage capability is severely limited due to the capacity of the hard drives in the voice mail systems. By compressing the voice input signals, significantly more voice messages can be stored on the same amount of storage space. Another application of the present invention is the transmission of voice signals. For example, at the transmitter, the voice signal may be compressed and the binary code words transmitted. At the receiver, as seen below, the syllabic sounds associated with the binary code words may be played back.

Figure 4:
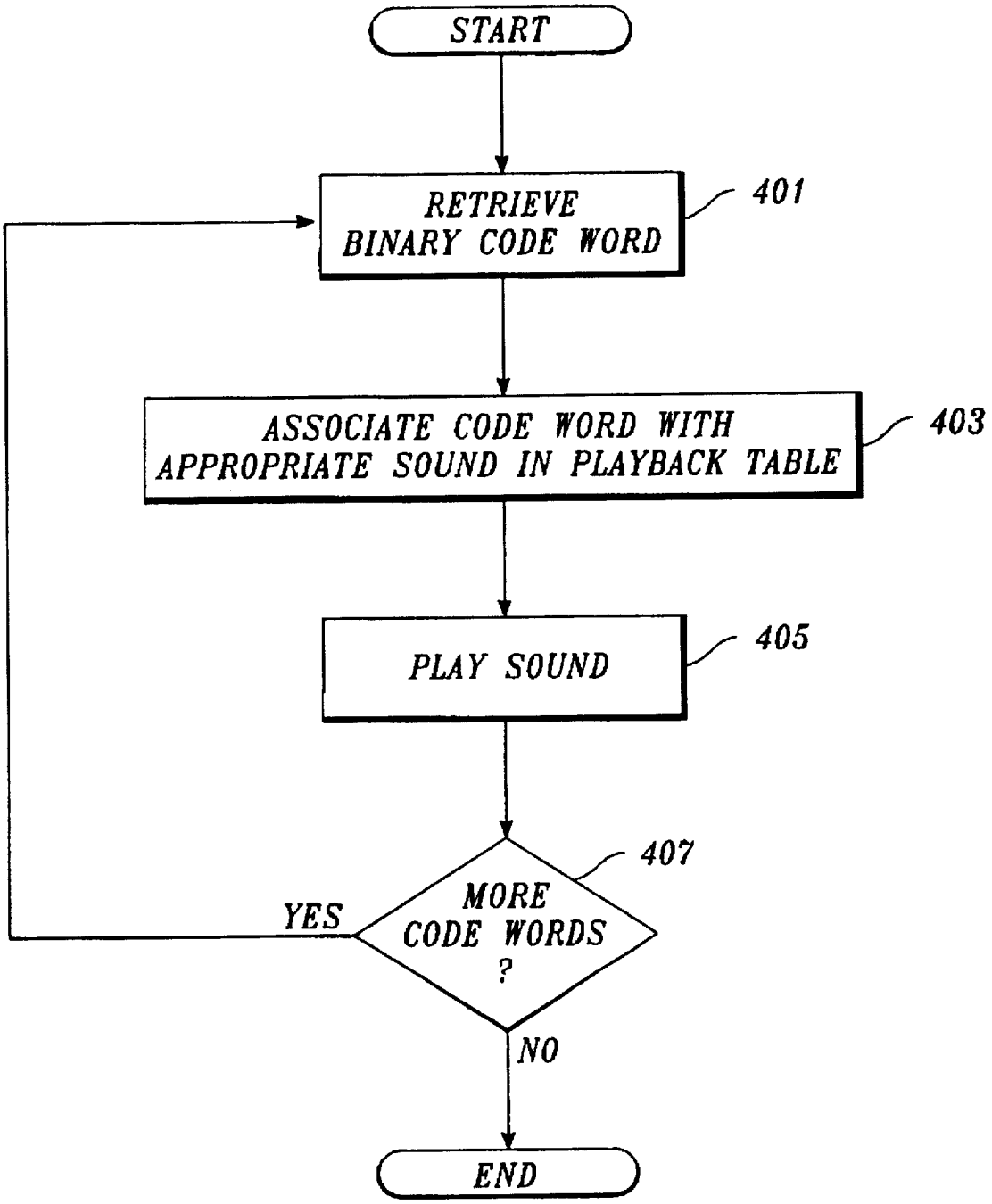
FIG. 4 is a flow diagram illustrating the retrieval and playback of compressed stored voice signals.

In order to play the stored voice input back to the user or to any other individual, the process of FIG. 4 is executed. At box 401, the first binary code word from the file to be played is retrieved. Next, at box 403, the binary code word that is retrieved is provided to CPU 113, which using a playback table, retrieves the appropriate syllabic sound. The playback table is a table that associates a binary code word with a particular syllabic sound. In the preferred embodiment, the playback table utilizes the voice recognition template by generating a sound in accordance with the composite frequency signature associated with the binary code word. However, instead of the composite frequency signature having a range of amplitudes for each frequency, an average amplitude is generated from the range of amplitudes.

Next, at box 405, CPU 113 sends the composite frequency signature to a voice generator 117 that can produce a signal to be played over speaker 107 to emulate the syllabic sound. Finally, at box 407, a check is made as to whether there are additional binary code words to be played back. If so, then control returns to box 401. If not, then the procedure is terminated.

While the preferred embodiment of the invention has been illustrated and described, it will be appreciated that various changes can be made therein without departing from the spirit and scope of the invention. For example, although the playback table in the preferred embodiment based upon the voice recognition template, it can be appreciated that the playback table can be formed by the user. Thus, the user can read into the apparatus each syllabic sound. When the playback mode is invoked, the user's own voice and previously read-in syllabic sounds are replayed to him. In addition, another method of generating the playback table may be for a professional "reader" with, for example, a pleasant voice, to read the syllabic sounds into the apparatus. When the playback mode is invoked, the professional reader's voice is replayed to the user.

The embodiments of the invention in which an exclusive property or privilege is claimed are defined as follows:

1. A method of compressing a voice signal, the method comprising the steps of:

(a) generating a voice recognition template, said voice recognition template associating a plurality of unique binary code words with a plurality of unique syllabic sounds, said unique syllabic sounds included within a predetermined set of syllabic sounds capable of representing substantially all possible syllabic sounds of all languages, said voice recognition template optimizable to include only those syllabic sounds necessary for a predetermined language;

(b) receiving said voice signal as a series of spoken syllables;

(c) selecting a selected binary code word from said voice recognition template whose associated syllabic sound is the most similar to said spoken syllable; and (d) repeating step (c) for each of said spoken syllables.

2. The method of claim 1 further including the step of storing said selected binary code word on a storage media for each of said spoken syllables in said series of spoken syllables.

3. The method of claim 1 further including the step of transmitting said selected binary code word for each of said spoken syllables in said series of spoken syllables.

4. The method of claim 1 wherein said step of generating a voice recognition template further includes the steps of:

(i) having a plurality of training speakers speak each of said syllabic sounds of said set of syllabic sounds into a microphone as a training voice signal;

(ii) generating a training frequency signature of said training voice signal for each of said plurality of training speakers;

(iv) forming a composite frequency signature from said training frequency signatures from said plurality of training speakers for each of said syllabic sounds; and (v) associating a unique binary code word with said composite frequency signatures for each of said syllabic sounds in said set of syllabic sounds.

5. The method of claim 1 wherein said step of generating a voice recognition template further includes the steps of:

(i) having an end user speak each of said syllabic sounds of said set of syllabic sounds into a microphone as a training voice signal;

(ii) generating a training frequency signature of said training voice signal;

(iv) forming a composite frequency signature from said training frequency signature for each of said syllabic sounds; and (v) associating a unique binary code word with said composite frequency signatures for each of said syllabic sounds in said set of syllabic sounds.

6. The method of claim 1 including the further step of filtering said voice signal.

7. The method of claim 4 including the further step of filtering said training voice signal.

8. The method of claim 4 wherein the step of selecting said selected binary code word includes the steps of:

(i) generating a frequency signature of said voice signal;

(ii) comparing said frequency signature to said composite frequency signatures; and (iii) selecting the selected binary code word associated with said composite frequency signature most similar to said frequency signature.

9. The method of claim 5 wherein the step of selecting said selected binary code word includes the steps of:

(i) generating a frequency signature of said voice signal;

(ii) comparing said frequency signature to said composite frequency signatures; and (iii) selecting the selected binary code word associated with said composite frequency signature most similar to said frequency signature.

10. A method of decompressing a binary code word formed in accordance with claim 1, said method including the steps of:

(i) generating a playback table that associates a playback binary code word to a playback syllabic sound;

(ii) retrieving from said playback table the syllabic sound associated with said binary code word; and (iii) playing said syllabic sound on a speaker.

11. An apparatus for compressing a voice signal, the apparatus comprising:

(a) a voice recognition template, said voice recognition template for associating a plurality of unique binary code words with a plurality of unique syllabic sounds, said unique syllabic sounds included within a predetermined set of syllabic sounds capable of representing substantially all possible syllabic sounds of all languages, said voice recognition template optimizable to include only those syllabic sounds necessary for a predetermined language;

(b) a microphone for receiving said voice signal as a series of spoken syllables; and (c) a voice processor for selecting a selected binary code word from said voice recognition template whose associated syllabic sound is the most similar to said spoken syllable.

12. The apparatus of claim 11 further including a data storage device for storing said selected binary code word for each of said spoken syllables in said series of spoken syllables.

13. The apparatus of claim 11 further including a filter for filtering said voice signal.

14. The apparatus of claim 11 wherein said voice processor further includes a spectrum analyzer for generating a frequency signature of said voice signal and a central processor for comparing said frequency signature to said voice recognition template and for selecting the selected binary code word whose associated syllabic sound is most similar to said frequency signature.

15. An apparatus for decompressing a binary code word formed in accordance with claim 1, said apparatus including:

(i) a voice processor for generating a playback table that associates a playback binary code word to a playback syllabic sound;

(ii) a central processor for retrieving from said playback table the syllabic sound associated with said binary code word; and (iii) a speaker for playing said syllabic sound.

16. A method of compressing a voice signal, the method comprising the steps of:

(a) generating a voice recognition template, said voice recognition template associating a plurality of unique binary code words with a plurality of unique syllabic sounds, said unique syllabic sounds included within a predetermined set of syllabic sounds representative of the Amharic language, said voice recognition template optimizable to include only those syllabic sounds necessary for a predetermined language;

(b) receiving said voice signal as a series of spoken syllables;

(c) selecting a selected binary code word from said voice recognition template whose associated syllabic sound is the most similar to said spoken syllable; and (d) repeating step (c) for each of said spoken syllables.

17. The method of claim 16, wherein the step of generating a voice recognition template includes the step of assigning 8-bit binary values to said plurality of unique binary code words.

18. The method of claim 16 wherein said step of generating a voice recognition template further includes the steps of:

(i) having a plurality of training speakers speak each of said syllabic sounds of said set of syllabic sounds into a microphone as a training voice signal;

(ii) generating a training frequency signature of said training voice signal for each of said plurality of training speakers;

(iv) forming a composite frequency signature from said training frequency signatures from said plurality of training speakers for each of said syllabic sounds; and (v) associating a unique binary code word with said composite frequency signatures for each of said syllabic sounds in said set of syllabic sounds.

19. The method of claim 16 wherein said step of generating a voice recognition template further includes the steps of:

(i) having an end user speak each of said syllabic sounds of said set of syllabic sounds into a microphone as a training voice signal;

(ii) generating a training frequency signature of said training voice signal;

(iv) forming a composite frequency signature from said training frequency signature for each of said syllabic sounds; and (v) associating a unique binary code word with said composite frequency signatures for each of said syllabic sounds in said set of syllabic sounds.

20. A method of decompressing a binary code word formed in accordance with claim 16, said method including the steps of:

(i) generating a playback table that associates a playback binary code word to a playback syllabic sound;

(ii) retrieving from said playback table the syllabic sound associated with said binary code word; and (iii) playing said syllabic sound on a speaker.

* * * * *